US007080017B2

(12) United States Patent
Fisher et al.

(10) Patent No.: US 7,080,017 B2
(45) Date of Patent: Jul. 18, 2006

(54) FREQUENCY COMPANDER FOR A TELEPHONE LINE

(76) Inventors: Ken Scott Fisher, 5521 Cleon Ave., N. Hollywood, CA (US) 91601; Kevin Cotton Baxter, 5521 Cleon Ave., N. Hollywood, CA (US) 91601; Fred H. Holmes, Route 3 Box 79, Cleveland, OK (US) 74103-3318

( * ) Notice: Subject to any disclaimer, the term of this patent is extended or adjusted under 35 U.S.C. 154(b) by 732 days.

(21) Appl. No.: 10/159,600

(22) Filed: May 31, 2002

(65) Prior Publication Data

US 2003/0225583 A1 Dec. 4, 2003

(51) Int. Cl.
*G10L 21/04* (2006.01)

(52) U.S. Cl. ..... 704/500; 704/205; 704/208

(58) Field of Classification Search ..... 704/500, 704/201, 205, 208, 268
See application file for complete search history.

(56) References Cited

U.S. PATENT DOCUMENTS 4,755,994 A * 7/1988 Staples et al. ..... 370/477
5,367,539 A * 11/1994 Copley ..... 375/347
5,388,185 A * 2/1995 Terry et al. ..... 704/205
5,539,452 A * 7/1996 Bush et al. ..... 348/14.13
5,872,531 A * 2/1999 Johnson et al. ..... 341/110
6,556,965 B1 * 4/2003 Borland et al. ..... 704/200.1

* cited by examiner

*Primary Examiner*—Tālivaldis Ivars Šmits
*Assistant Examiner*—Leonard Saint-Cyr

(57) ABSTRACT

A frequency compander for improving the frequency response of a telephone line when used for remote broadcasting. The inventive device comprises an encoder for compressing the frequency spectrum of an audio signal and a decoder for expanding the signal back to its original spectrum. Preferably the encoder comprises: an anti-aliasing filter; an A/D converter for digitizing incoming audio; a DSP for compressing the audio; and a D/A converter for outputting compressed audio to the phone line. The decoder comprises: an anti-aliasing filter; an A/D converter for digitizing the incoming compressed signal; a DSP for restoring the original audio; and a D/A converter for outputting program audio. In a preferred embodiment, encoding and decoding are performed in the frequency domain. In another preferred embodiment, encoding and decoding are performed in the time domain using trigonometric transformations.

17 Claims, 4 Drawing Sheets

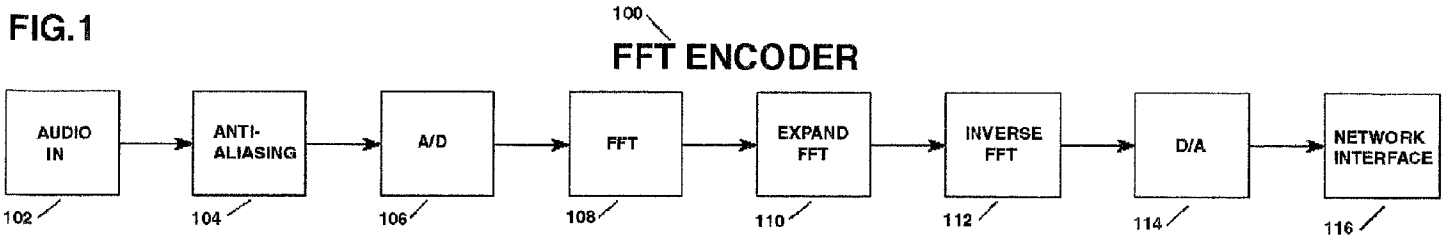
FIG.1
100
FFT ENCODER
AUDIO IN
102
ANTI-ALIASING
104
A/D
106
FFT
108
EXPAND FFT
110
INVERSE FFT
112
D/A
114
NETWORK INTERFACE
116

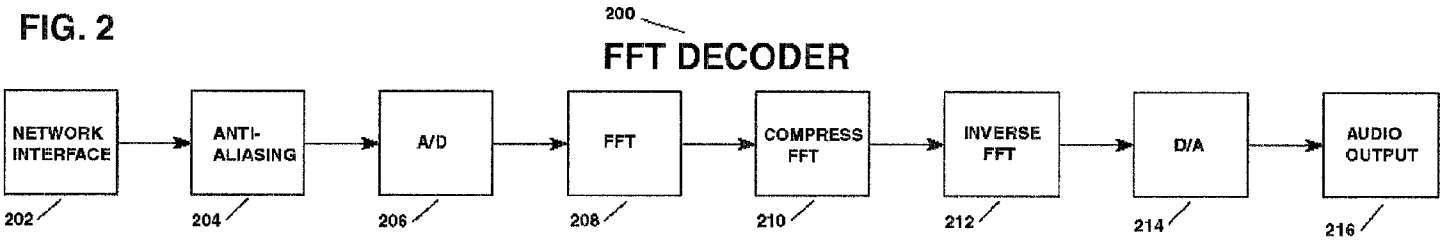
FIG. 2
200
FFT DECODER
NETWORK INTERFACE
202
ANTI-ALIASING
204
A/D
206
FFT
208
COMPRESS FFT
210
INVERSE FFT
212
D/A
214
AUDIO OUTPUT
216

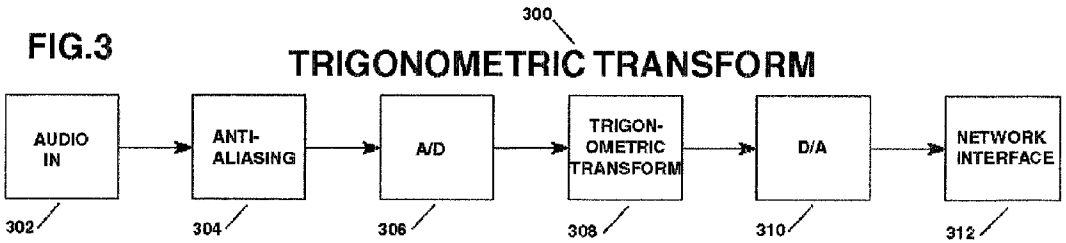
FIG.3
300
TRIGONOMETRIC TRANSFORM
AUDIO IN
302
ANTI-ALIASING
304
A/D
306
TRIGON-OMETRIC TRANSFORM
308
D/A
310
NETWORK INTERFACE
312

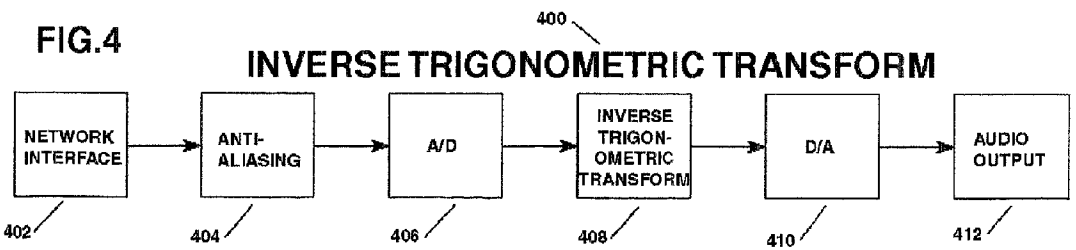
FIG.4
400
INVERSE TRIGONOMETRIC TRANSFORM
NETWORK INTERFACE
402
ANTI-ALIASING
404
A/D
406
INVERSE TRIGON-OMETRIC TRANSFORM
408
D/A
410
AUDIO OUTPUT
412

FREQUENCY COMPANDER FOR A TELEPHONE LINE

BACKGROUND OF THE INVENTION

1. Field of the Invention

The present invention relates to frequency extenders for a telephone line. More particularly, but not by way of limitation, the present invention relates to a frequency extender to expand the bandwidth of a dialup telephone line used to carry remote audio programming.

2. Background of the Invention

Virtually every broadcaster, whether radio or television, has at some point in time, felt the need to carry programming originating from a remote location. In response to this need, a number of solutions have been developed. Unfortunately, every method presently used for remote broadcasting suffers from its own set of disadvantages.

Presently radio frequency devices are the favored method for sending programming from a remote location to a studio or transmitter for broadcast. Devices offered for this purpose are often referred to as a "remote pickup unit" or "RPU."

Perhaps the favored RPU is a microwave link. Such systems have excellent bandwidth, good signal to noise performance, and usually include bi-directional operation. In most cases the microwave RPU is built into a van, SUV, truck, or the like. Since microwave signals are basically line-of-sight in nature, there is normally an extendible mast on the vehicle to raise the antenna high enough to clear obstacles and increase the range. Even so, microwave links have a limited range. In addition to line of sight operation, microwave systems suffer from a number of other limitations which include: the equipment is expensive, so expensive, in fact, that most small market radio stations would be hard pressed to purchase even a single system; there is setup time in extending the mast and aiming the remote antenna towards the receiving antenna; microwave systems require a dedicated vehicle; overhead power lines can pose a significant risk to the operator while extending the mast; and, like all RF devices, there is a potential for interference and fade.

Perhaps the most pervasive RPU is the UHF or VHF two-way radio. While two way radios are available for a number of bands, by far UHF radios are the most popular, typically operating in the vicinity of 450 MHz. These radios offer moderate bandwidth and cost a mere fraction of the cost of microwave systems. Unfortunately, two-ways are particularly subject to interference, especially in large metropolitan areas where the frequency selected by a radio station for its two-way equipment is likely shared with other businesses. As a result, a remote broadcast may be interrupted by other radio operators. Even if a broadcaster's two-way radio frequency is exclusive, use of such radios has become so pervasive that interference from equipment operating on adjacent channels is common place. Furthermore, while two-way radio transmissions are not limited to line of sight like their microwave counterparts, such radios still suffer from limited range and require a significant investment by a broadcaster.

Remote programming may also be sent to a radio station over the public telephone network. A telephone link has virtually unlimited range, is rarely affected by outside noise sources, and requires only a minimal investment. Unfortunately, if a switched line is used, the bandwidth provided by a telephone connection is marginal at best. The frequency response of a telephone line is generally 300 Hz to 3100 Hz. In comparison, the frequency response of an FM radio broadcast is generally 30 Hz to 15 KHz. Audio sent through a phone line is degraded to the point where even the most untrained ear can distinguish it from other programming. In fact, in competitive radio markets some broadcasters refuse to use dialup phone lines to carry any programming, even for live remotes.

Since bandwidth is the principal disadvantage to using the switched telephone network, a number of techniques are used by radio stations to reduce the problem of limited bandwidth. One solution is to employ a dedicated leased telephone line. Leased lines are directly connected between the source and destination locations. While 10 KHz bandwidth may be available with such lines, the costs are substantially higher than with a conventional phone line, the phone company requires some lead time to install and connect the line, and there is usually a minimum period over which the line must be leased. As a result, a leased line is not practical for most remote broadcasting events.

Another solution to the bandwidth problem is the frequency extender. In its simplest form, a frequency extender shifts the source audio up 250 Hz prior to its transmission over the phone lines. At the receiving end, the frequency of the program audio is shifted back down 250 Hz to its original frequency. The magic of a frequency extender lies in the nature of the frequency range provided by the telephone company on a phone line. As previously mentioned, the typical bandwidth of a phone line is 300 Hz to 3100 Hz, a range of just over three octaves. The frequency shifting technique used by a frequency extender shifts the frequency range to roughly 50 Hz to 2850 Hz, or over five and one-half octaves. At the upper end, where frequency range is sacrificed, 250 Hz is a mere fraction of an octave. At the lower end, the added range from 50 Hz to 300 Hz is well over two octaves. As those familiar with such devices will readily appreciate, as a result of frequency extension, the audio exhibits a fuller, richer sound than audio transmitted without the benefit of such extension. Of course, even with the improved sound, the high end of the audio spectrum is still absent from the program.

To improve high-end performance, multi-line extenders are available. These devices use this same frequency-shifting technique to recover higher portions of the audio spectrum, 2800 Hz at a time. Beyond the obvious problems of requiring the simultaneous use of multiple telephone lines, these devices traditionally have required some setup to compensate for variances in the characteristics of each of the phone lines.

More recently, the broadcast industry has turned to digital codecs. Codecs are available for conventional phone lines, ISDN lines, and even for use over the Internet. In a digital codec, program audio is first digitized, then radically compressed, transmitted in digital form by a modem across the telephone network, received by a modem at the receiving end, decompressed, and finally, converted back to analog form. Such devices can yield amazing improvements in the apparent bandwidth. Unfortunately, they also have a number of limitations, including: 1) digital codecs are presently very expensive, at least compared to their frequency-shifting counterparts; 2) the actual digital throughput of a particular connection is unpredictable and can vary widely, not only from connection-to-connection between the same two locations, but even during a single session; 3) the reproduced audio is typically reconstructed through a "model" and is not the actual audio produced so that the result may include spurious sounds not in the original audio, sounds may be lost in the conversion process, and downstream processing of the audio can yield unpredictable and unwanted results; 4) the quality of the audio is dependent on the digital throughput;

and 5) long gaps in the program audio can occur if the modems lose synchronization and must re-handshake. Despite the popularity of codecs, the state of the art of digital transmission over the switched telephone network is just not quite ready for audio broadcast purposes.

Yet another method for handling a remote broadcast is via a cellular telephone connection. While a cellular-to-cellular connection is possible, normally a cellular telephone is used to call a conventional dialup line at the radio station. Analog cell phones are rapidly becoming a relic. However, at least as long as signal strength is adequate, the problems encountered with a cellular connection are basically the same as those encountered with a conventional telephone line, specifically bandwidth. Like a conventional connection, this problem may be somewhat relieved through the use of frequency extenders. An additional annoyance with analog cell phones is the occasional switching between cell sites which causes a momentary "hole" in the audio signal.

Presently, the cellular network is transitioning to all digital. Like the digital frequency extender mentioned above, digital cell phones rely heavily on compression techniques to maximize the amount of audio information which can be transmitted at a relatively low bit rate. Unfortunately, these compression techniques produce a received signal which is essentially a synthesis of the original signal. As is well known in the art, as the system becomes congested or as signal strength degrades, the recovered audio often becomes unintelligible. Furthermore, downstream processing of audio transmitted over a digital cellular connection may produce unpredictable results. Present frequency compression technique are generally not well suited for use with digital cellular phones.

It should be noted that many digital cell phones provide a data connection and there are devices which make use of such a connection to transmit compressed and digitized audio via the digital port on the cell phone. Presently the data rates provided through such phones is too low for the transmission of audio information, even when heavily processed, especially in light of the fact that with many phones, the digital connection may be shared among several users, i.e. with a CDPD connection.

Finally, it is a common practice in the field to direct talent over a separate communication channel typically know as an "interruptible feedback" line or "IFB." Particularly in the television industry, a phone connection, or cell phone, is often used for an IFB even when programming is sent via an RF link. Since the talent receives cues over the IFB, it is important that such cues be readily intelligible. Thus there is a need for systems which will improve the quality of off-line audio used for remote cuing.

Thus it is an object of the present invention to provide a system and method for frequency extension which provides suitable bandwidth over a conventional switched telephone connection.

It is a further object of the present invention to transmit the information in an audio form such that consistent results are provided from one connection to the next.

It is still a further object of the present invention to provide a lowcost frequency extender which substantially doubles the bandwidth of a telephone connection.

SUMMARY OF THE INVENTION

The present invention provides a frequency compander for connection to a telephone line, or a cellular telephone network, which will provide a substantial improvement in bandwidth of the telephone line. Unlike prior art extenders which merely shift the frequency to make better use of the available bandwidth, the present invention sacrifices signal-to-noise performance of the connection in exchange for increased bandwidth.

In a preferred embodiment, an encoder processes program audio by filtering the signal, converting the audio to a digital form, and compressing the audio into a narrower spectrum through a process described herein as "frequency companding". In general, the term "companding" is used to describe a combined process of COMPressing and exPANDing (emphasized with capital letter to improve clarity). In one preferred embodiment, the signal is transformed into the frequency domain through a continuous Fourier Transform. The transformed data is manipulated to maintain the resolution of the transformed data but to compress the information into one-half, or less, of the spectrum. A continuous inverse transform is then performed and the signal is converted back to analog to for transmission over the public network. At the receiving end, the process is reversed in a decoder to expand the signal, in the frequency domain, back to the original program.

The companding process is not without its costs, the signal-to-noise ratio of the original signal suffers degradation due to phase noise arising in the companding process and through lost resolution in the noise floor of the signal. In return, however, the decoded signal is produced with roughly twice the bandwidth, or more, of the public network channel used. It is generally reasonable to expect −45 dB, or better, signal to noise ratio on a dialup line. With frequency doubling, the signal will still have about −40 dB signal to noise ratio.

In a second preferred embodiment, the frequency is compressed into at least half the spectrum, in a point-by-point process using a well-known trigonometric transformation. At the decoder, the signal is expanded using an inverse trigonometric transformation.

In another preferred embodiment the inventive frequency compander includes a microphone input, a headphone output, and a keypad for management of the public network connection such that the device is a stand alone system for performing a remote broadcast.

The present invention is distinguishable from prior art systems in that: 1) analog frequency extenders only shift the frequency of the program audio, as opposed to compressing, to restore the missing lower frequencies; and 2) present digital frequency extenders compress the audio and attempt transmission in a digital form, as opposed to sending an analog audio signal shifted down one or more octaves, which relies on modeling of the human hearing or vocal tract to decompress. The advantage of the present invention over analog frequency extenders is a vast improvement in bandwidth. Advantages of the present invention over prior art digital extenders include: dramatically lower cost; more consistent operation, e.g., less dependency on the quality of the phone line for the quality of the received audio; and an analog output which is suitable for downstream processing.

Further objects, features, and advantages of the present invention will be apparent to those skilled in the art upon examining the accompanying drawings and upon reading the following description of the preferred embodiments.

BRIEF DESCRIPTION OF THE DRAWINGS

FIG. 1 provides a flow diagram for a process for encoding frequency extended audio through an FFT.

FIG. 2 provides a flow diagram for a process for decoding frequency extended audio through an FFT.

FIG. 3 provides a flow diagram for a process for encoding frequency extended audio through a trigonometric transform.

FIG. 4 provides a flow diagram for a process for decoding frequency extended audio through a trigonometric transform.

DESCRIPTION OF THE PREFERRED EMBODIMENTS

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figure 5:
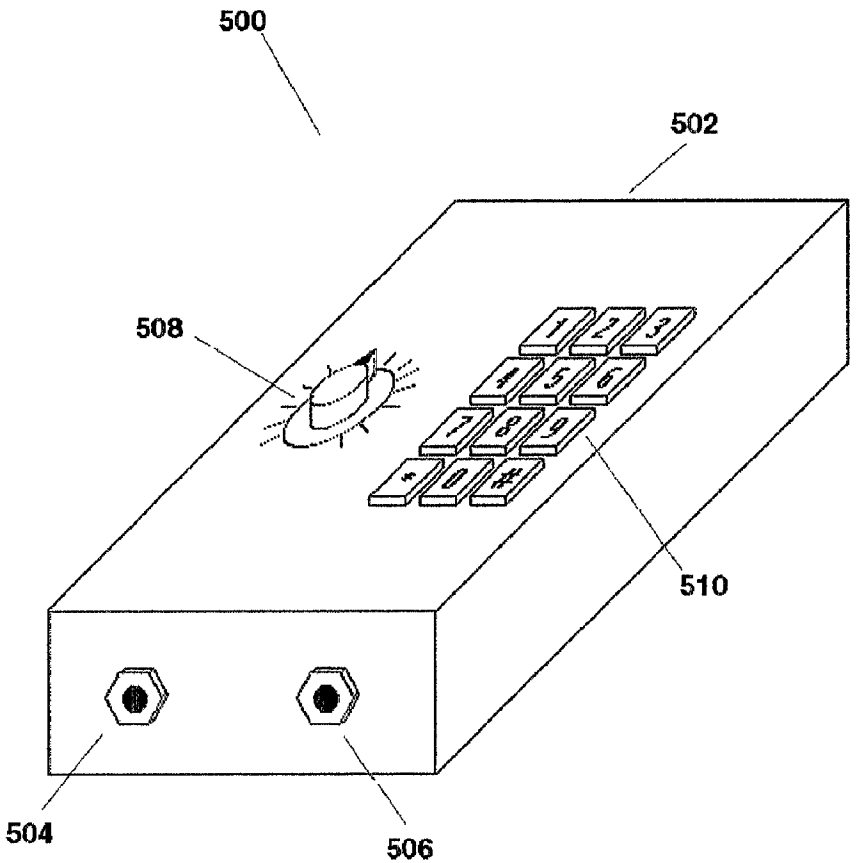
FIG. 5 provides a perspective view of the inventive frequency compander.

Referring now to the drawings, wherein like reference numerals indicate the same parts throughout the several views, a typical frequency compander 500 is shown in FIG. 5. Preferably, compander 500 comprises: enclosure 502; microphone jack 504, typically an industry standard 3-pin XLR connector for the connection of a microphone 602 (FIG. 6), or other audio source; a headphone jack 506, typically a ¼ inch phone jack for the connection of a pair of headphones 604 (FIG. 6); a knob 508 for adjusting the volume of the audio sent to headphones 604; and a keypad 510 for controlling the operation of extender 500, particularly with respect to its connection with a telephone network.

In addition, compander 500 includes a modular phone jack (not shown) for connection to a telephone network and a power connector 704 for receiving electrical power on its rear panel (not shown).

As discussed above purpose of frequency compander 500 is to improve the fidelity of audio transmitted over a public network. For purposes of this invention, a "public network" is a system for point-to-point audio communication, such as, by way of example and not limitation, the telephone network, a cellular phone/pcs network, a two-way radio network, or the like. As also discussed above, as used herein, the term "compander", or "companding," refer to a device for, or the process of, frequency compressing and frequency expanding.

A frequency compander is particularly useful for performing a remote broadcast for a radio station, television station, etc., where because of the bandwidth normally broadcast by the station, the listener has come to expect a level of sound quality better than that normally available over the public networks. Frequency companding is performed by encoding the audio signal at the remote site by shifting the frequency of the signal, compressing the spectrum occupied by the signal, or a combination of both, transmitting the encoded signal over the network, and decoding and/or shifting the compressed signal at the receiving end to restore the original audio program.

Figure 7:
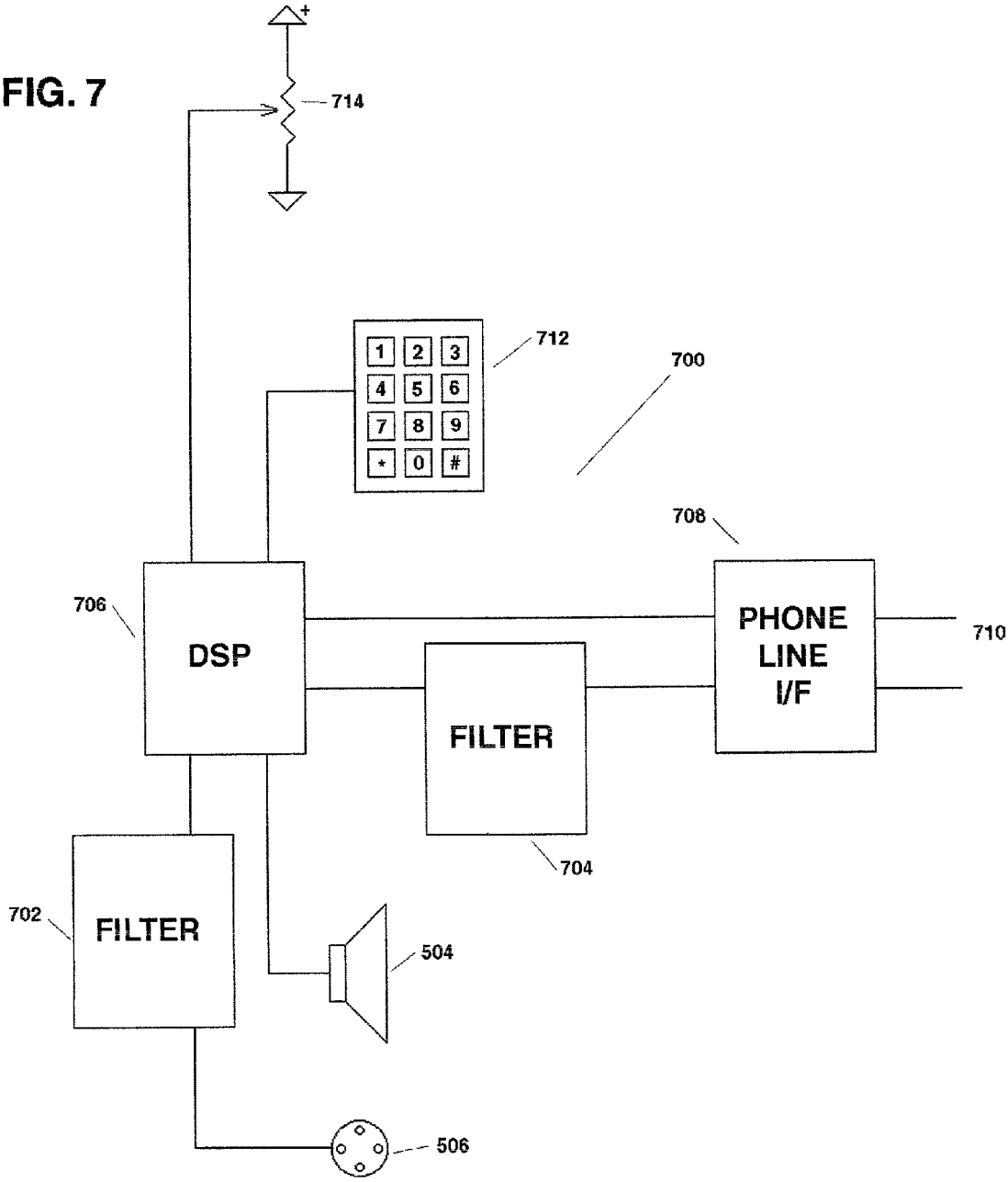
FIG. 7 provides a block diagram of the circuitry of a preferred frequency compander.

Referring next to FIG. 7, circuitry for encoding and decoding the audio signal 700 comprises: a digital signal processor ("DSP") 706; a microphone jack 506 for receiving an audio program; an anti-aliasing filter 704 to low pass filter the audio at, or below, one-half the sampling frequency to prevent quantitization noise; a phone line interface 710 which provides phone line functions such as, proper audio coupling to the phone line, 2 wire-to-4 wire conversion, ring detection hook management, etc.; keypad 712 which allows the user to go off-hook, or on-hook, to dial a phone number, or select operating modes of the extender; potentiometer 714 for adjusting the volume of the audio delivered to headphone connector 506.

With further reference to FIG. 1, wherein a flow diagram is shown for the encoding process 100, audio is first brought to compander 500 through connector 504 at step 102. As mentioned above, the audio is directed through an anti-aliasing filter 704 at step 104 to remove high frequency content above the maximum frequency to be transmitted. Next at step 106, to encode the audio program, DSP 706 performs a series of program steps which first sample the incoming audio and convert the signal to digital form on a periodic basis. At step 108, the incoming signal is transformed from the time domain to the frequency domain on a sample-by-sample basis through a conventional fast Fourier transform. Fourier transforms are well known in the art and the programming of a DSP to perform such a transform is well within the skill level of one of ordinary skill in the art. To perform a continuous FFT on the incoming data, a running buffer of the last sixteen samples are used for each transformation. As each new sample is read, it is placed at the beginning of the buffer while the oldest sample falls off the opposite end of the buffer. As will be apparent to those skilled in the art, the FFT produces a frequency domain table wherein phase and amplitude information is stored relative to frequency. Data stored in this table is indicative of characteristics of the incoming signal relative to the spectral content of the audio program. At step 110, the data is next copied into the lower half of a table of twice the size of the original table. Each location of the top half of both the larger table is set to zero. Next, an inverse fast Fourier is performed on the larger table on a sample-by-sample basis at step 112 to produce an output buffer in the time domain wherein the spectral information of the original signal is compressed by factor of two from the original signal. Finally, the top value of the large table is converted from digital to analog at step 114 to produce the audio signal sent to the public network at 116.

Referring next to FIGS. 2 and 7, the process of decoding 200 is very similar in nature to the process of encoding 100 (FIG. 1). First, at step 202, audio is received from the public network interface 708. The audio is conditioned at step 204 by anti-aliasing filter 704 to remove out-of-band noise received on the phone line. The output of filter 704 is sampled, converted to digital form, and placed in a 32-byte buffer in a first in first out fashion at step 206. Next, at step 208, the buffer is transformed to the frequency domain through a fast Fourier transform. The lower half of the frequency domain table is then copied into a table of one-half the size at step 210 before being subjected to an inverse transform at step 212. The output buffer of the transform of step 212 is 16-bytes in length and of the same spectral content as the original signal at step 106 of the encoder (FIG. 1), preferably on the order of twice that of the public network. The top value of the buffer is then processed through a digital to analog converter at step 214 to produce program audio at step 216.

As will be apparent to those skilled in the art, if each unit contains both encoding software and decoding software, then high fidelity audio may be sent both from the remote location to the studio and from the studio back to the remote location. This is particularly helpful when a director at the studio wishes to cue the talent at the remote location or where the program is sent back to the remote location so that the talent may be cued over-the-air.

Figure 6:
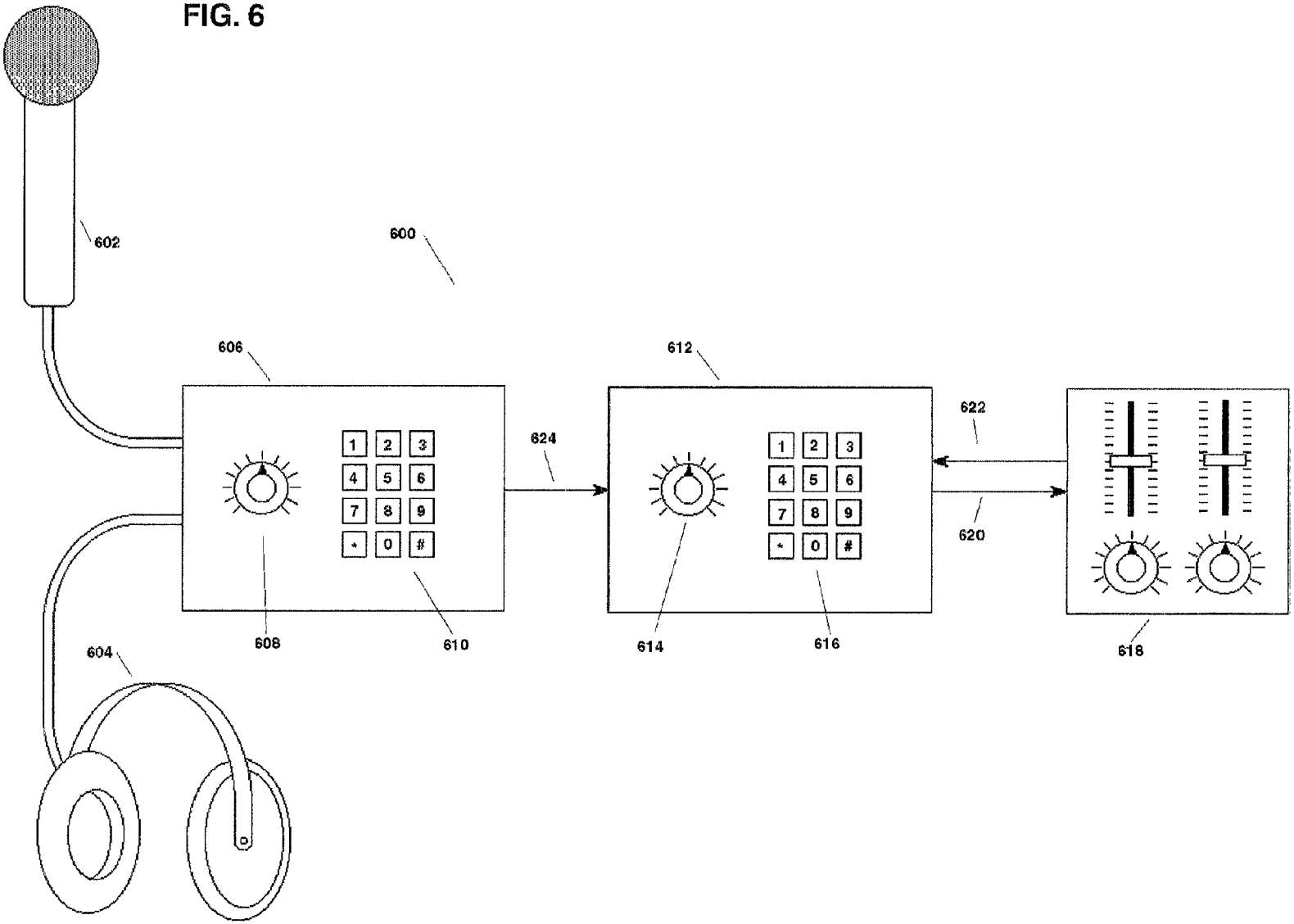
FIG. 6 provides a diagram of a system for remote broadcast incorporating the inventive frequency compander.

Turning next to FIG. 6, a system for remote broadcasting 600 preferably comprises: a remote frequency compander 606 having an audio source such as microphone 602 and a audio monitoring device such as headphones 604; and a local frequency compander 612 located at a studio or transmitter and connected to a public network, typically a conventional dialup phone line 624. The audio output 620 of local compander 612 is preferably connected to an input of mixer 618 so that incoming remote audio is under the control of local personnel. Similarly, audio input 622 of local compander 612 is preferably connected to a monitor output of mixer 618 so that audio returned to the remote location, i.e. audible directions or actual on-the-air programming, is also under local control.

To initiate a remote broadcast, the operator connects remote compander 606 to the phone network 624 and, using keypad 610, dials the phone number of local compander 612. Upon detecting the ringing signal, local compander 612 answers the call and a bi-directional audio link is established. It should be noted that audio traveling in both directions is compressed. Accordingly any reflections, or echoes, caused by the phone network 624 will be properly decompressed and thus sound normal either at headphones 604 or at mixer 618. As will be appreciated by those who have attempted uncompressed talk-back with analog extenders, both encoding and decoding must be performed at both ends of the connection if bi-directional communications are to be used.

Frequency companding can be accomplished in a number of different ways. By way of example and not limitation, another preferred method for frequency companding is shown in FIGS. 3 and 4, wherein well-known trigonometric transformations are used in lieu of the FFT and inverse FFT steps 108–112 and 208–212 of FIGS. 1 and 2, respectively. In encoder 300, the audio information is inputted at step 302, filtered at step 304, and converted to a digital representation at periodic intervals at step 306, just as in encoder 100 (FIG. 1). At step 308 frequency compression is then performed on the sampled data on a sample-by-sample basis according to the following equation:

$$\cos(X/2)=\mathrm{sqrt}(½+\cos(X)/2)$$

where:

cos(X) is the audio input; and cos(X/2) is the audio output.

It should be noted that the square root of the above equation results in full-wave rectification of the output signal. Accordingly, upon the detection of a local minimum value of the input, a sign reversal of the output must be made. After this adjustment, the result of this transformation is: frequency shifting down one octave.

Following the transformation, the sample is converted back to an analog signal at step 310 before being output to the public network as compressed audio at step 312.

Like FFT decoder 200, trigonometric decoder 400 inputs compressed audio from the public network at step 402, filters the signal at step 404, and digitizes the signal at step 406. Decompression is performed at step 408 using the inverse of the transform of step 308 given by:

$$\sin(2X)=2*\sin(X)*\cos(X)$$

where:

sin(2X) is the output of the decoder; and sin(X) is the input to the decoder.

As will be apparent to those skilled in the art, the input signal must be shifted 90 degrees to develop cos(X) to complete the transform. The Hilbert filter is a well known method for achieving a constant 90 degree phase shift over a wide range of frequencies. The Hilbert filter is particularly well suited for implementation in an FIR filter which is, in turn, well suited for DSP applications. In consideration of the fact that Hilbert filters require an odd number of filter coefficients, preferably a Hilbert filter for producing the quadrature of the compressed audio signal will employ at least 17 coefficients. As will also be apparent to those skilled in the art, the incoming signal is shifted up one octave by the above transform, precisely restoring the input signal to encoder 300.

As with prior art frequency extenders, to make best use of the bandwidth of a telephone line, it may also be desirable to shift the frequency of the compressed signal up 250 Hz to achieve good low frequency response across the phone line. If so desired, this may be easily accomplished within the computer program for DSP 706 by processing the output of the transformation of either encoder 100 or 300 according to the formula:

$$\sin(X+250)=\sin(X)*\cos(250)+\cos(X)*\sin(250)$$

where:

sin(X) is the compressed audio; and sin(X+250) is the signal delivered to the public network.

At the receiving end, after digitization 206 or 406, but prior to expansion 208 or 408, the 250 Hz offset may be removed from the compressed audio according to:

$$\sin(X)=\sin(X+250)*\cos(250)-\cos(X+250)*\sin(250)$$

As will be apparent to those skilled in the art, when performed within the digital signal processor 706 (FIG. 7), the shifting process described above is identical to that of prior art frequency extenders. Preferably, the 250 Hz signal will be drawn from a lookup table. Simultaneous generation of both sine and cosine waves is then simply a matter of pulling two values, one for sine, and the other for cosine, from the table with a fixed offset between the pointers for each wave. It should be noted too that the quadrature signal may be developed for the incoming audio signal through a Hilbert filter as discussed hereinabove.

As will be apparent to those skilled in the art, compander 500 could include computer software to communicate with conventional frequency extenders, as well as a mating compander 500. Acting as a frequency extender, compander 500 would simply frequency shift uncompressed audio, as detailed above, up 250 Hz in the encoding process, and down 250 Hz in the decoding process. Such a device would be universal in the sense that, talent working for multiple stations could use the device to send remote programming to a station regardless of the local receiving equipment at the station. Unprocessed audio could be sent to a station having no special equipment. Frequency extended audio could be sent to a station having only a prior art frequency extender. And frequency companded audio could be sent to a station having a frequency compander. As will also be apparent to those skilled in the art, it would be possible, through spectral analysis of a test signal, such as a 1 KHz sine wave, to distinguish the encoding scheme from among the possible schemes. Upon determining the encoding scheme, compander 500 could then automatically configure itself to operate according to the compression or shifting scheme of the transmitting device.

It is well known that various models and brands of older frequency extenders were of questionable compatibility with each other. The DSP of the inventive device may be programmed to precisely tailor itself to any encoder or decoder at the other end of the connection by analysis of a test signal, such as a 1 KHz sine wave. As will be apparent to those skilled in the art, the inventive system could thus be used to also implement a precision frequency extender which avoids the problems associated with the large number of passive components, the tolerances of such components, and the costs and inaccuracies associated with analog multipliers used in prior art frequency extenders.

As will also be apparent to those skilled in the art, the companding process described herein could be repeated to achieve any desired bandwidth, at least up to the point where the signal to noise ratio becomes objectionable. In addition, in the FFT approach described above, while the process was described with regard to doubling the bandwidth, by a judicious selection of the sizes of the frequency domain tables, it is possible to obtain virtually any reasonable level of improvement in a single pass of the encoder and decoder. Since the tables can be increased or decreased in size by even a single location, fractional improvements in bandwidth are even possible.

Yet another possibility of the present invention is that both shifting and compression of the signal may be obtained by manipulation of the frequency domain table. For example, the data could be shifted up 250 Hz, as discussed above, simply by moving the data in the frequency domain table up the appropriate number of locations in the table. The 250 Hz shift of the compressed data would occur automatically in the inverse FFT. Similarly, in the expansion process, the data in the table would simply be shifted down in the table by 250 Hz to remove the offset.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention.

What is claimed is:

1. A frequency compander for improving the bandwidth of audio sent via a public network comprising: input means for receiving an audio signal; encoding means for compressing the frequency spectrum of said audio signal, said encoding means having an output means for outputting a compressed analog audio signal within the time domain; and network interface means for connection to a public network, wherein said compressed analog audio signal is transmitted to said public network through said network interface means.

2. The frequency compander of claim 1 wherein said encoding means comprises a digital signal processor, said input means comprises an analog to digital converter, and said output means comprises a digital to analog converter.

3. The frequency compander of claim 2 wherein said encoding means further comprises a software program for performing an FFT and an inverse FFT.

4. The frequency compander of claim 1 wherein said input means is a first input means, said output means is a first output means and said compressed analog audio signal is a first compressed analog audio signal, further comprising: a second input means for inputting a second compressed analog audio signal received from said network interface; a decoding means in communication with said second input means for expanding said second compressed analog audio signal; and a second output means for delivering program audio, wherein, said program audio is expanded from said second compressed analog audio signal.

5. A frequency compander for improving the frequency response of an audio transmission channel comprising: an anti-aliasing filter having an input for receiving an audio signal; an analog to digital converter in communication with said anti-aliasing filter to digitize said audio signal; a digital signal processor in communication with said analog to digital converter, said digital signal processor executing a computer program which includes steps to compress the frequency spectrum of said audio signal and restore it to the time domain; a digital to analog converter for outputting compressed analog audio signal from said digital signal processor to the audio transmission channel.

6. The frequency compander of claim 5 wherein said analog to digital converter is a first analog to digital converter, said input is a first input, and said digital to analog converter is a first digital to analog converter and said compressed analog audio signal is a first compressed analog audio signal further comprising: a second analog to digital converter having a second input for inputting a second compressed analog audio signal; a second digital to analog converter for outputting an expanded audio signal, wherein said computer program further includes steps to expand said second compressed analog audio received at said second analog to digital converter into said expanded audio signal.

7. A method for compressing audio information including the steps of: (a) inputting an audio signal; (b) digitizing said audio signal; (c) compressing the frequency spectrum from the digitized audio signal of step (b) into compressed data; (d) converting said compressed data to an analog signal within the time domain; (e) transmitting said analog signal over a public network; (f) repeating steps (b)–(e) on a periodic basis.

8. The method for compressing audio information of claim 7 wherein step (c) includes the steps of: (c)(i) performing a fast Fourier transform on the digitized audio signal of step (b) to form a frequency domain table; (c)(ii) increasing the size of said frequency domain table, in proportion to the degree of frequency compression to be performed, the new table locations being disposed above the existing data in said frequency domain table, relative to the spectral content of said existing data, said new locations being cleared; and (c)(iii) performing an inverse fast Fourier transform on said frequency domain table of increased size of step (c)(ii).

9. The method for compressing audio information of claim 7 wherein the compressing of step (c) comprises a trigonometric transformation.

10. A method for expanding the frequency spectrum of a compressed audio signal including the steps of: (a) inputting a compressed analog audio signal; (b) digitizing said compressed analog audio signal; (c) expanding the frequency spectrum from the digitized compressed audio signal of step (b) into program audio data; (d) converting said program audio data to an analog form within the time domain for subsequent transmission; and (e) repeating steps (b)–(d) on a periodic basis.

11. The method for expanding the frequency spectrum of a compressed audio signal of claim 10 wherein step (c) includes the substeps of: (c)(i) performing a fast Fourier transform on the digitized compressed audio signal of step (b) to form a frequency domain table, said frequency domain of a size to include spectral information of said compressed audio signal at least to the highest frequency to be recovered; (c)(ii) decreasing the size of the table to contain only spectral information from 0 Hz to a first frequency, said first frequency being the highest frequency programmed in said compressed audio data, discarding the information stored in said table for frequencies above said first frequency; and (c)(iii) performing an inverse fast Fourier transform on said frequency domain table of decreased size of step (c)(ii).

12. The method for expanding the frequency spectrum of a compressed audio signal of claim 10 wherein the expanding of step (c) comprises a trigonometric transformation.

13. A method for selecting a decoding scheme in a frequency compander including the steps of: (a) connecting a frequency compander to a telephone line at a first location; (b) connecting a remote broadcast device to a telephone line at a second location; (c) establishing a connection between said remote broadcast device and said frequency compander over the telephone network; (d) transmitting a test tone of a predetermined frequency from said remote broadcast device to said frequency compander; (e) determining the frequency of the tone received at said frequency compander; and (f) selecting a mode of operation based on the frequency determined in step (e) from the group consisting of (f)(i) frequency extender mode; (f)(ii) frequency companding with shifting mode; (f)(iii) frequency companding without shifting mode.

14. The method for selecting a decoding scheme in a frequency compander of claim 13 including the additional steps of (g) upon selecting the operating mode of(f)(ii), subtracting said predetermined frequency from said frequency of said tone received; and (h) adjusting the shift frequency to the difference determined in step (g).

15. A precision frequency extender for extending the lower frequency range by shifting the frequency of an audio program comprising: an A/D converter for digitizing incoming audio; a digital signal processor, said digital signal processor receiving digitized audio from said A/D converter, a D/A converter in communication with said digital signal processor for outputting frequency shifted audio, wherein said digital signal processor performs a series of programming steps to shift the frequency spectrum of said incoming audio according to a trigonometric transformation to create said frequency shifted audio and outputs a frequency shifted audio signal in the time domain, via said D/A converter.

16. The precision frequency extender of claim 15 wherein the frequency extender is an encoder and wherein said digital signal processor shifts the frequency spectrum of said incoming audio up 250 Hz.

17. The precision frequency extender of claim 15 wherein the frequency extender is a decoder and wherein said digital signal processor shifts the frequency spectrum of said incoming audio down by 250 Hz.

* * * * *